US007814718B2

(12) United States Patent
Klein

(10) Patent No.: US 7,814,718 B2
(45) Date of Patent: Oct. 19, 2010

(54) HEAD-OF-WALL FIREBLOCKS

(76) Inventor: James A. Klein, 6200 119th Pl. NE., Bellevue, WA (US) 98006

( * ) Notice: Subject to any disclaimer, the term of this patent is extended or adjusted under 35 U.S.C. 154(b) by 0 days.

(21) Appl. No.: 12/727,058

(22) Filed: Mar. 18, 2010

(65) Prior Publication Data

US 2010/0170171 A1 Jul. 8, 2010

Related U.S. Application Data

(63) Continuation of application No. 12/098,274, filed on Apr. 4, 2008, now Pat. No. 7,681,365.

(60) Provisional application No. 60/997,521, filed on Oct. 4, 2007, provisional application No. 61/007,439, filed on Dec. 13, 2007.

(51) Int. Cl.
*E04C 2/00* (2006.01)

(52) U.S. Cl. ..... 52/232; 52/481.1; 52/302.1; 52/241; 52/1

(58) Field of Classification Search ..... 52/481.1, 52/302.1, 241, 1, 232, 242, 633
See application file for complete search history.

(56) References Cited

U.S. PATENT DOCUMENTS

| | | | |
|---|---|---|---|
| 2,218,426 | A | 10/1940 | Hulbert, Jr. |
| 2,683,927 | A | 7/1954 | Maronek |
| 3,324,615 | A | 6/1967 | Zinn |
| 3,397,495 | A | 8/1968 | Thompson et al. |
| 3,481,090 | A | 12/1969 | Joseph |
| 3,537,219 | A | 11/1970 | Navarre |
| 3,566,559 | A | 3/1971 | Dickson |
| 3,744,199 | A | 7/1973 | Navarre |

(Continued)

FOREIGN PATENT DOCUMENTS

| | | |
|---|---|---|
| CA | 2234347 | 10/1999 |

(Continued)

OTHER PUBLICATIONS

Order form from Stockton Products for Soffit Vent / Reveal Screed, in 1 page.

(Continued)

*Primary Examiner*—Richard E Chilcot, Jr.
*Assistant Examiner*—Alp Akbasli
(74) *Attorney, Agent, or Firm*—Thomas E. Loop; Graybeal Jackson LLP

(57) ABSTRACT

The invention disclosed herein is directed to a fire retardant head-of-wall assembly configured to seal a linear head-of-wall construction joint or gap when exposed to a heat source such as a building fire. The inventive fire retardant head-of-wall assembly comprises a header track having an elongated intumescent strip affixed lengthwise on at least one of the outer sidewall surfaces of the header track. When exposed to a heat source such as a building fire, the intumescent strip is able to expand so as to at least partially fill the head-of-wall construction joint or gap; and in so doing, retard or prevent the spread of smoke and fire. The inventive fire retardant head-of-wall assembly has been certified as complaint with respect to Underwriters Laboratories, Inc.'s standards set forth in its Tests for Fire Resistance of Building Joint Systems—UL 2079.

15 Claims, 5 Drawing Sheets

U.S. PATENT DOCUMENTS

| | | | |
|---|---|---|---|
| 3,935,681 | A | 2/1976 | Voiturier et al. |
| 3,955,330 | A | 5/1976 | Wendt |
| 3,964,214 | A | 6/1976 | Wendt |
| 4,011,704 | A | 3/1977 | O'konski |
| 4,103,463 | A | 8/1978 | Dixon |
| 4,130,972 | A | 12/1978 | Varlonga |
| 4,164,107 | A | 8/1979 | Kraemling et al. |
| 4,283,892 | A | 8/1981 | Brown |
| 4,329,820 | A | 5/1982 | Wendt |
| 4,649,089 | A | 3/1987 | Thwaites |
| 4,672,785 | A | 6/1987 | Salvo |
| 4,723,385 | A | 2/1988 | Kallstrom |
| 5,010,702 | A | 4/1991 | Daw et al. |
| 5,103,589 | A | 4/1992 | Crawford |
| 5,125,203 | A | 6/1992 | Daw |
| 5,127,203 | A | 7/1992 | Paquette |
| 5,157,883 | A | 10/1992 | Meyer |
| 5,285,615 | A | 2/1994 | Gilmour |
| 5,325,651 | A | 7/1994 | Meyer et al. |
| 5,394,665 | A | 3/1995 | Johnson |
| 5,471,805 | A | 12/1995 | Becker |
| 5,644,877 | A | 7/1997 | Wood |
| 5,687,538 | A | 11/1997 | Frobosilo et al. |
| 5,755,066 | A | 5/1998 | Becker |
| 5,787,651 | A | 8/1998 | Horn et al. |
| 5,806,261 | A | 9/1998 | Huebner et al. |
| 5,913,788 | A | 6/1999 | Herren |
| 5,921,041 | A | 7/1999 | Egri, II |
| 5,927,041 | A | 7/1999 | Sedlmeier et al. |
| 5,930,963 | A | 8/1999 | Nichols |
| 6,058,668 | A | 5/2000 | Herren |
| 6,176,053 | B1 | 1/2001 | St. Germain |
| 6,213,679 | B1 | 4/2001 | Frobosilo et al. |
| 6,216,404 | B1 | 4/2001 | Vellrath |
| 6,233,888 | B1 | 5/2001 | Wu |
| 6,374,558 | B1 | 4/2002 | Surowiecki |
| 6,732,481 | B2 | 5/2004 | Stahl, Sr. |
| 6,799,404 | B2 | 10/2004 | Spransy |
| 6,871,470 | B1 | 3/2005 | Stover |
| 7,240,905 | B1 | 7/2007 | Stahl, Sr. |
| 2002/0170249 | A1 | 11/2002 | Yulkowski |
| 2004/0010998 | A1 | 1/2004 | Turco |
| 2004/0045234 | A1 | 3/2004 | Morgan et al. |
| 2004/0211150 | A1 | 10/2004 | Bobenhausen |
| 2006/0137293 | A1 | 6/2006 | Klein |
| 2007/0261343 | A1 | 11/2007 | Stahl, Sr. et al. |
| 2008/0250738 | A1 | 10/2008 | Howchin |
| 2009/0038764 | A1 | 2/2009 | Pilz et al. |
| 2009/0049777 | A1 | 2/2009 | Pilz et al. |
| 2009/0049781 | A1 | 2/2009 | Pilz et al. |

FOREIGN PATENT DOCUMENTS

| | | |
|---|---|---|
| GB | 2411212 | 8/2005 |
| WO | WO 03/038206 | 5/2003 |
| WO | WO 2007/103331 | 9/2007 |

OTHER PUBLICATIONS

DoubleTrack information sheets by Dietrich Metal Framing, in 2 pages.

Catalog page from Stockton Products, printed from www.stocktonproducts.com, on Dec. 16, 2007, showing #5 Drip, in 1 page.

FireStik by CEMCO Brochure, published on www.firestik.us, in 18 pages.

HEAD-OF-WALL FIREBLOCKS

CROSS-REFERENCE TO RELATED APPLICATIONS

This application is a continuation of U.S. application Ser. No. 12/098,274 filed on Apr. 4, 2008 now U.S. Pat. No. 7,681,365, which application claims the benefit of U.S. Provisional Application No. 60/997,521 filed on Oct. 4, 2007, and U.S. Provisional Application No. 61/007,439 filed on Dec. 13, 2007, which application are all are incorporated herein by reference in their entireties for all purposes.

TECHNICAL FIELD

The present invention relates generally to fire blocking and containment systems used in the construction of buildings and, more particularly, to fireblocks and fire blocking systems used to seal dynamic head-of-wall construction joints and gaps.

BACKGROUND OF THE INVENTION

Metal framing assemblies used to construct commercial and residential buildings are common in the building construction arts. These metal framing assemblies are generally constructed from a plurality of metal framing members including studs, joist, trusses, and other metal posts and beams formed from sheet metal and frequently fabricated to have the same general cross-sectional dimensions as standard wood members used for similar purposes. Metal framing members are typically constructed by roll-forming 12 to 24 gauge galvanized sheet steel. Although many cross-sectional shapes are available, the primary shapes used in building construction are C-shaped studs and U-shaped tracks.

In the building construction trade, a head-of-wall joint (also sometimes referred to as a top-of-wall joint) refers to the linear junction or interface existing between a top section of a framing/wallboard wall assembly and the ceiling (where the ceiling may be a next-level floor or corrugated pan roof deck, for example). Head-of-wall joints often present a serious challenge in terms of reducing or preventing the spread of smoke and fire during a building fire. In this regard and in common practice, a wall to ceiling connection of many newly constructed buildings consists essentially of an inverted U-shaped elongated steel channel (or track) configured to receive steel studs between the legs of the shaped channel. A wallboard is generally attached to at least one side of the studs. The studs and wallboard are in many instances spaced apart from the ceiling a short gap distance in order to allow for ceiling deflections caused by seismic activity or moving overhead loads. Channel and stud assemblies that allow for ceiling deflections are commonly referred to as dynamic head-of-wall systems. Exemplary steel stud wall constructions may be found in U.S. Pat. Nos. 4,854,096 and 4,805,364 both to Smolik, and U.S. Pat. No. 5,127,203 to Paquette. Exemplary dynamic head-of-wall systems having steel stud wall constructions may be found in U.S. Pat. No. 5,127,760 to Brady, and U.S. Pat. No. 6,748,705 to Orszulak et al.

In order to contain the spread of smoke and fire, a fire resistant material such as, for example, mineral wool is often times stuffed into the gaps between the ceiling and wallboard (see, e.g., U.S. Pat. No. 5,913,788 to Herren). For example, mineral wool is often stuffed between a steel header track (e.g., an elongated U-shaped channel) and a corrugated steel roof deck (used in many types of steel and concrete building constructions); a fire resistant and generally elastomeric spray coating is then applied onto the exposed mineral wool to thereby form a fire resistant joint seal (see, e.g., U.S. Pat. No. 7,240,905 to Stahl)). In certain situations where the ceiling to wallboard gap is relatively small, a fire resistant and elastomeric caulk is commonly applied so as to fill any small gaps. In still another approach and as disclosed in U.S. Pat. Nos. 5,471,805 and 5,755,066 both to Becker, a slidable noncombustible secondary wall member is fastened to an especially configured steel header track and immediately adjacent to the wallboard. In this configuration, the secondary wall member provides a fire barrier that is able to accommodate ceiling deflections. All of these approaches, however, are relatively labor intensive and thus expensive.

Intumescent materials have long been used to seal certain types of construction gaps such as, for example, conduit through-holes. In this regard, intumescent and fire barrier materials (often referred to as firestop materials or fire retardant materials) have been used to reduce or eliminate the passage of smoke and fire through openings between walls and floors and the openings caused by through-penetrations (i.e., an opening in a floor or wall which passes all the way through from one room to another) in buildings, such as the voids left by burning or melting cable insulation caused by a fire in a modern office building. Characteristics of fire barrier materials suitable for typical commercial fire protection use include flexibility prior to exposure to heat, the ability to insulate and/or expand, and the ability to harden in place upon exposure to fire (i.e., to char sufficiently to deter the passage of heat, smoke, flames, and/or gases). Although many such materials are available, the industry has long sought better and more effective uses of these materials and novel approaches for better fire protection, especially in the context of dynamic head-of-wall construction joints and gaps.

Thus, and although construction joints and gaps are generally sealed in some manner (e.g., mineral wool and/or elastomeric coatings; see also, U.S. Patent Application No. 2006/0137293 to Klein), there are relatively few products and methods available that effectively and efficiently seal head-of-wall construction joints and gaps (to thereby significantly enhance the ability of such joints and gaps to withstand smoke and fire penetration). In particular, there are very few products and methods available that address the needs for adequate fire protection and sealing of dynamic head-of-wall systems associated with steel stud wall constructions. Thus, there is still a need in the art for new and improved fireblock systems and fire retarding devices, including related wall assemblies and methods. The present invention fulfills these needs and provides for further related advantages.

SUMMARY OF THE INVENTION

In brief, the present invention in one embodiment is directed to a fire retardant head-of-wall assembly configured to seal a linear head-of-wall construction joint or gap when exposed to a heat source. The innovative fire retardant head-of-wall assembly comprises: (1) an elongated sheet-metal footer track; (2) an elongated sheet-metal header track confronting and vertically spaced apart from the footer track, the header track including a web integrally connected to a pair of spaced apart and downwardly extending sidewalls, the web having a top exterior web surface positioned immediately adjacent to a ceiling and a bottom interior web surface, each sidewall being substantially coplanar and having inner and outer sidewall surfaces, each sidewall having an upper sidewall portion adjacent to the web and a lower sidewall portion; (3) an elongated intumescent strip affixed lengthwise on at least one of the outer sidewall surfaces of the pair of sidewalls, the intumescent strip being positioned on the upper sidewall portion, the intumescent strip having an outer strip surface offset from the outer sidewall surface an intumescent strip offset distance; (4) a plurality of sheet-metal studs having upper and lower end portions, the studs being vertically positioned between the spaced apart and confronting footer and header tracks such that the lower end portions are received into the footer track and the upper end portions are received into the header track, each of the upper end portions of the plurality of studs being spaced apart from the bottom interior web surface of the header track a first gap distance that allows for ceiling deflections; and (5) wallboard attached to at least one side of the plurality of studs, the wallboard having a top linear end surface positioned apart from the ceiling a second gap distance that allows for ceiling deflections and defines the construction joint of gap, the wallboard having an elongated upper interior wallboard surface in contact with the outer strip surface of the elongated intumescent strip.

In another embodiment, the present invention is directed to an elongated U-shaped sheet-metal track that includes (1) a web integrally connected to a pair of spaced apart and outwardly extending sidewalls, (2) a plurality of vertically aligned slots positioned along at least one of the sidewalls, and (3) at least one intumescent strip positioned along the sidewall having the plurality of vertically aligned slots and juxtaposed to the web.

BRIEF DESCRIPTION OF THE DRAWINGS

The drawings are intended to be illustrative and symbolic representations of certain exemplary embodiments of the present invention and as such they are not necessarily drawn to scale. In addition, it is to be expressly understood that the relative dimensions and distances depicted in the drawings (and described in the "Detailed Description of the Invention" section) are exemplary and may be varied in numerous ways. Finally, like reference numerals have been used to designate like features throughout the several views of the drawings.

DETAILED DESCRIPTION OF THE INVENTION

Figure 1:
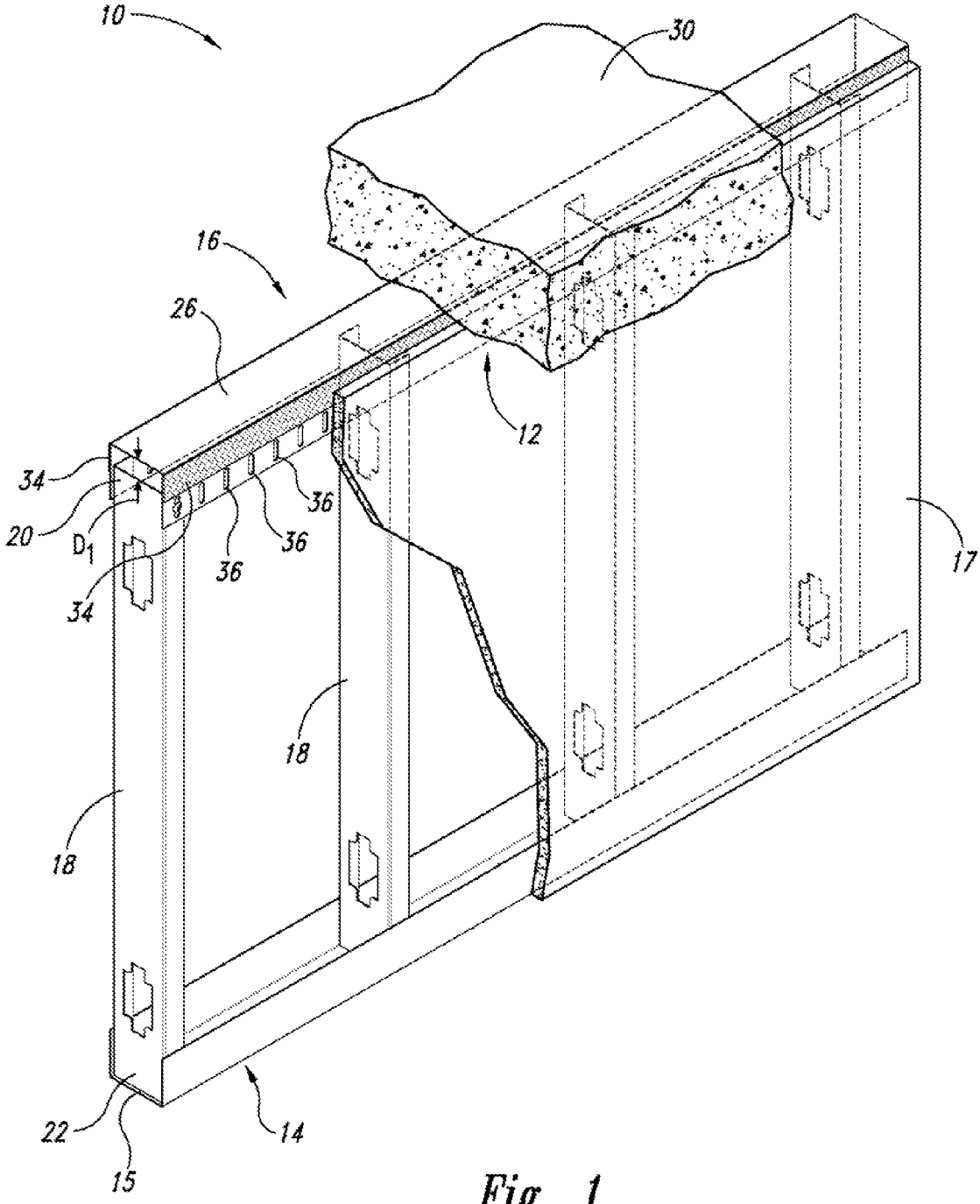
FIG. 1 illustrates a side perspective view of a fire retardant dynamic head-of-wall assembly in accordance with one embodiment of the present invention, wherein the head-of-wall assembly is configured to seal a linear head-of-wall construction joint or gap when exposed to a heat source such as a building fire.

Referring now to the drawings wherein like reference numerals designate identical or corresponding elements, and more particularly to FIGS. 1-5, the present invention in one embodiment is directed to a fire retardant head-of-wall assembly 10 configured to seal a linear head-of-wall construction joint or gap 12 when exposed to a heat source such as a building fire. As best shown in FIG. 1, the inventive fire retardant head-of-wall assembly 10 comprises an elongated sheet-metal footer track 14 confronting and vertically spaced apart from an elongated sheet-metal header track 16. The fire retardant head-of-wall assembly 10 further comprises a plurality of sheet-metal studs 18 having upper and lower end portions 20, 22 with the studs 18 being vertically positioned between the footer and header tracks 14, 16 such that the lower end portions 22 are received into the footer track 14 and the upper end portions 20 are received into the header track 16. More specifically, the lower end portions 22 of each stud 18 are engaged within the footer track 14 and immediately adjacent to a top interior web surface 15 of the footer track 14, while the upper end portions 20 of each stud 18 are engaged within the header track 16 and proximate to a bottom interior web surface 23 of the header track 16.

Figure 3B:
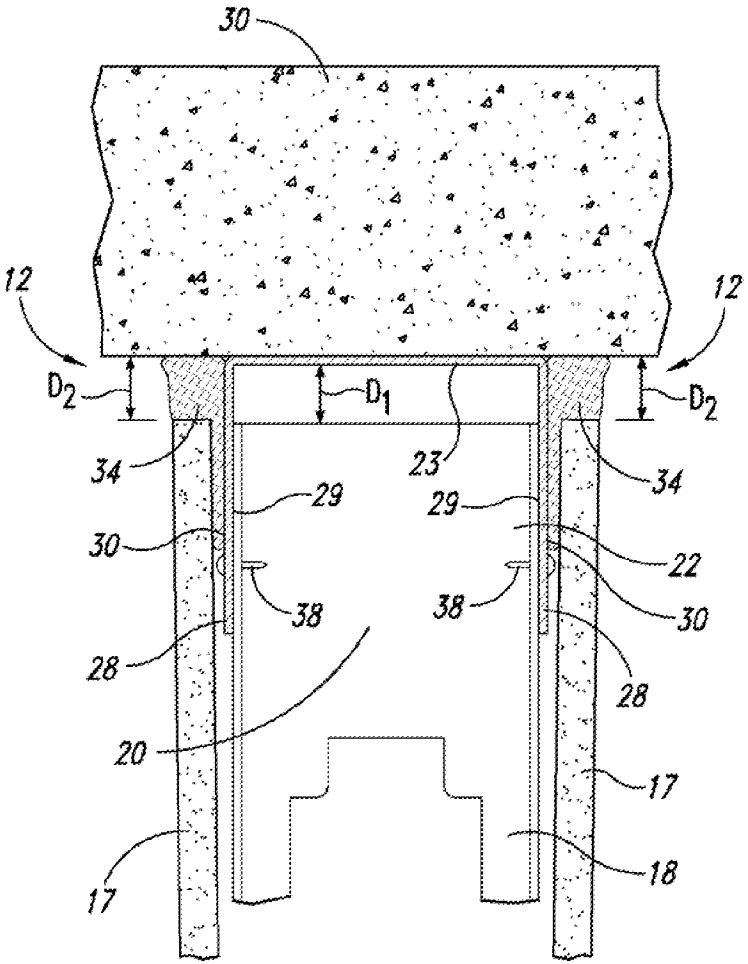
FIG. 3B illustrates a side view of an upper section of the fire retardant dynamic head-of-wall assembly shown in FIG. 1, but where the intumescent strips have been exposed to a heat source and, consequently, have expanded so as to seal the linear head-of-wall construction joint or gap.
Figure 3A:
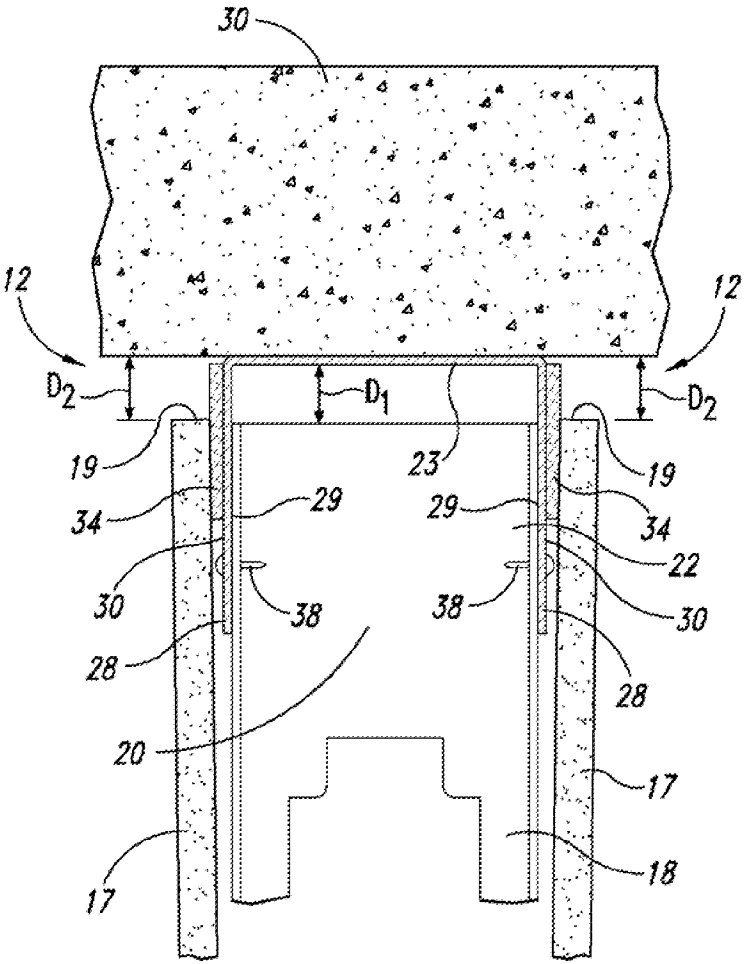
FIG. 3A illustrates a side view of an upper section of the fire retardant dynamic head-of-wall assembly shown in FIG. 1.

In this configuration and as best shown in FIGS. 3A-B, each upper end portion 20 of the plurality of studs 18 is spaced apart from the bottom interior web surface 23 a first gap distance $D_1$ that allows for ceiling deflections (caused by seismic activity or moving overhead loads, for example). The first gap distance $D_1$ generally ranges from about ⅛ to about ⅝ inches (depending on the design specification of the wall assembly 10), and preferably is about ⅜ of an inch. In addition, wallboard 17 is attached to at least one side of the plurality of studs 18, with the wallboard 17 having a linear top end surface 19 positioned apart from a ceiling 30 a second gap distance $D_2$ that similarly allows for ceiling deflections and defines the aforementioned linear construction joint or gap 12. The second gap distance $D_2$ also generally ranges from about ⅛ to about ⅝ inches (depending on the design specification of the wall assembly 10), and preferably is also about ⅜ of an inch. In other words, the first gap distance $D_1$ and the second gap distance $D_2$ are preferably the same or about the same, thereby each allowing for ceiling deflections of the same amplitude.

Figure 2:
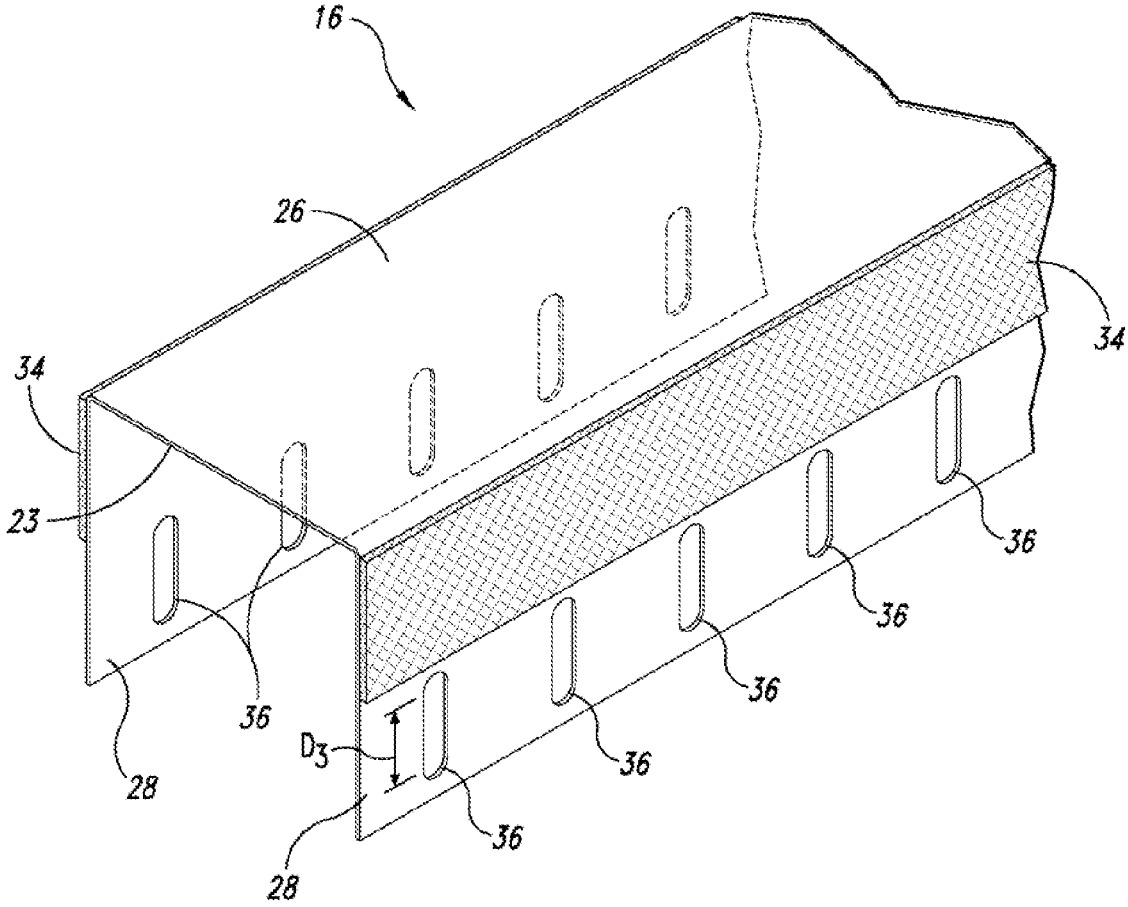
FIG. 2 illustrates a side perspective view of a sheet-metal header track having intumescent strips positioned lengthwise along the sidewalls in accordance with an embodiment of the present invention.
Figure 4:
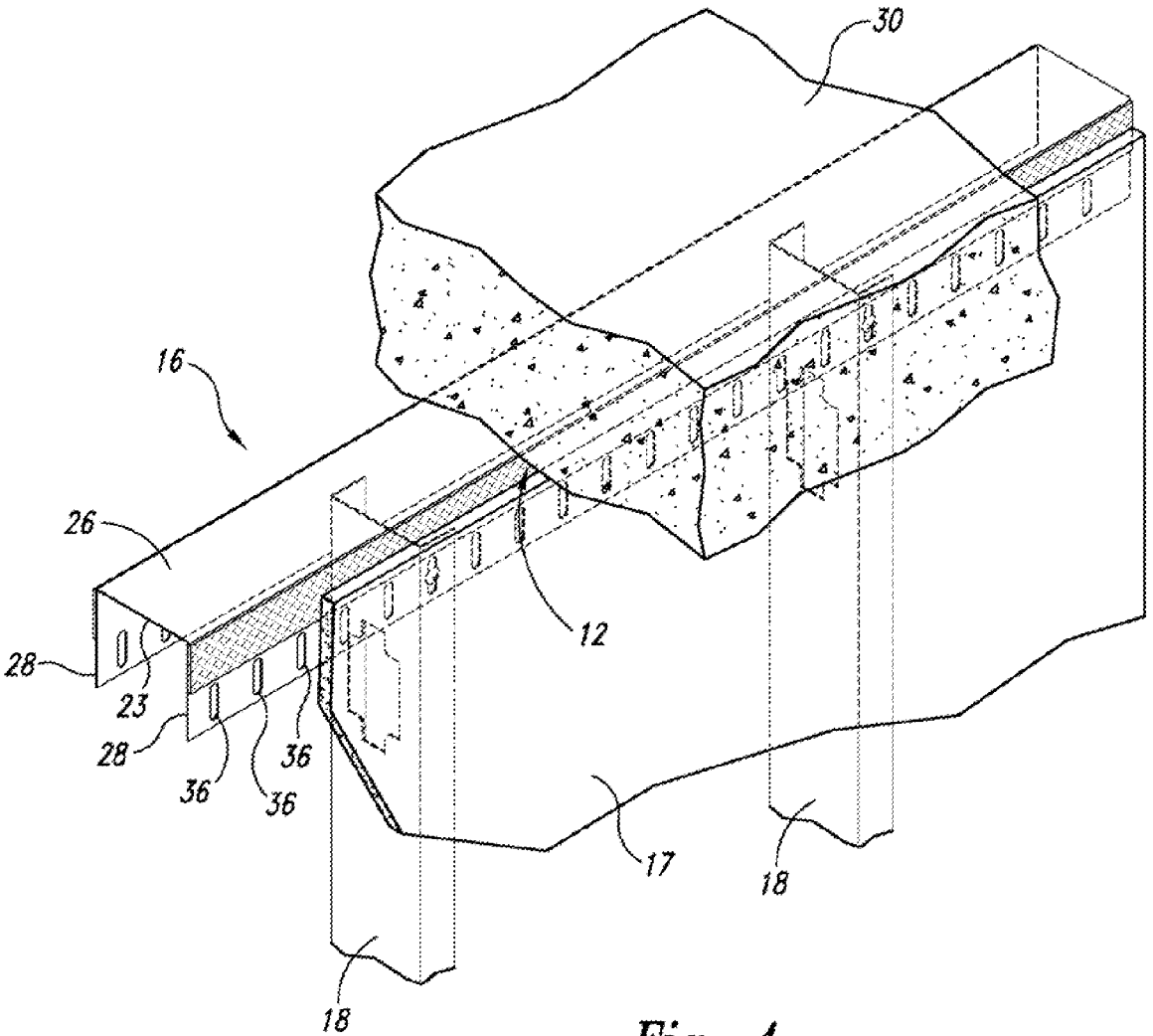
FIG. 4 illustrates a side perspective top partial view of the upper section of the fire retardant head-of-wall assembly shown in FIG. 1.

As best shown in FIGS. 2-4, the elongated sheet-metal header track 16 (of the head-of-wall assembly 10) comprises a web 26 integrally connected to (and flanked by) a pair of spaced apart and downwardly extending sidewalls 28 (also sometimes referred to as legs). The web 26 includes the bottom interior web surface 23 and a top exterior web surface positioned immediately adjacent to the ceiling 30. Each sidewall 28 is substantially coplanar (meaning no inwardly extending pockets or grooves that could otherwise interfere with the vertical movement or cycling of the plurality of studs 18) and has inner and outer sidewall surfaces 29, 30. As shown, an elongated intumescent strip 34 is affixed lengthwise on at least one of the sidewalls 28, namely, on an upper portion of one of the outer sidewall surfaces 30. The intumescent strip 34 has an outer planar strip surface offset from the outer sidewall surface 30 an intumescent strip offset distance generally equal to its thickness (which is preferably about ⅛ inch). In addition, the wallboard 17 has an elongated upper planar interior wallboard surface that linearly contacts and bears against the outer strip surface of the intumescent strip 34. Moreover, the intumescent strip 34 has a width that is generally equal to at least twice the first gap distance $D_1$, while the top linear end surface 19 of the wallboard 17 is preferably positioned perpendicular and about midway along the width of the intumescent strip 34. In this configuration, the elongated intumescent strip 34 is able to slide up and down (i.e., cycle) with respect the stationary wallboard 34 when a ceiling 30 deflection event occurs.

The intumescent strip 34 is commercially available (e.g., 3M Company or The Rectorseal Corporation, U.S.A.) and preferably has an adhesive backing that allows it to be readily affixed onto the outer sidewall surface 30. Exemplary in this regard are the heat expandable compositions disclosed in U.S. Pat. No. 6,207,085 to Ackerman (incorporated herein by reference), which discloses a composition that, when subjected to heat, expands to form a heat-insulating barrier. The composition comprises a resinous emulsion that contains an expandable graphite, a fire retardant, and an optional inorganic intumescent filler. In order to ensure that the intumescent strip 34 stays in place when exposed to heat, it has been found that a commercially available (e.g., 3M Company, U.S.A.) fire-retardant epoxy adhesive may preferably also be used.

Examples of emulsions for use in the intumescent material are acrylic emulsions, polyvinyl acetate emulsions, silicone emulsions, and styrene butadiene emulsions. In one embodiment of the invention, a resinous aqueous emulsion of a polyvinyl acetate may be used. In addition to aqueous emulsions, the resinous emulsion for use in the composition of the intumescent material may consist of emulsions of polymers within an organic solvent, such as hydrocarbons, like xylene and toluene. In addition, keto alcohols or similar co-solvents can be used. In a preferred embodiment, diacetone alcohol co-solvent is used in combination with water. In such instances, between about 0.5 to about 10 weight percent, preferably less than one weight percent of the composition prior to extrusion is co-solvent.

The composition of the intumescent material (prior to extrusion) contains about 15 to about 90, preferably between about 25 to 90, most preferably between about 30 to about 60, weight percent of resinous emulsion.

Suitable styrene-butadiene polymers may be characterized as those polymers having from about 99 to about 65, preferably 99 to 80, weight percent of a $C_8$-$C_{12}$ vinyl or vinylidene aromatic monomer and the remainder being butadiene. The styrenic moiety can be optionally substituted with a $C_1$-$C_4$ alkyl or hydroxy alkyl radical or a chlorine or bromine atom.

Such polymers may further comprise one or more copolymerizable monomers containing a functional group. When present, the functional monomers are present in an amount from about 0.5 to about 6 weight percent. The functional monomers may be selected from the group consisting of (1) one or more $C_3$-$C_6$ ethylenically unsaturated carboxylic acids; (2) one or more amides of $C_3$-$C_6$ ethylenically unsaturated carboxylic acids, which amide may be substituted or unsubstituted at the nitrogen atom by a $C_1$-$C_4$ alkyl or hydroxy alkyl radical; (3) one or more $C_3$-$C_6$ ethylenically unsaturated aldehydes; and (4) one or more $C_1$-$C_6$ alkyl or hydroxy alkyl esters of $C_3$-$C_6$ ethylenically unsaturated carboxylic acids. Suitable $C_8$-$C_{12}$ vinyl aromatic monomers include styrene, alpha methyl styrene and chlorostyrene. Part of the aromatic monomer may be replaced by small amounts of an alkenyl nitrile such as acrylonitrile. Suitable conjugated diolefins include the aliphatic diolefins such as 1,3-butadiene, isoprene and their chlorinated homologues. Up to about half, preferably less than about 20 percent of the conjugated diolefin may be replaced with an ester of acrylic or methacrylic acid; or a vinyl ester of a saturated carboxylic acid. Suitable esters are those of acrylic or methacrylic acid such as methyl acrylate, methyl methacrylate, ethyl acrylate, ethyl methacrylate, hydroxyethyl acrylate, hydroxy ethyl methacrylate and the higher branched esters such as ethyl hexyl acrylate and ethyl hexyl methacrylate. Suitable vinyl esters include vinyl acetate.

The resin within the emulsion of the composition of the intumescent material may further include commercially available acrylic resins such as those derived from acrylic acid, methacrylic acid, itaconic acid, fumaric acid, methyl acrylate, methyl methacrylate, ethyl acrylate, ethyl methacrylate, butyl acrylate, ethyl hexyl methacrylate, ethyl hexyl acrylate, acrylamide, methacrylamide, N-methylol acrylamide, N-methylol methacrylamide and/or acrolein.

The acrylate type polymers may further be characterized as polymers consisting of from about 60 to 99.5, preferably from about 85 to about 94.5 weight percent of a $C_1$-$C_8$ alkyl or hydroxy alkyl ester of acrylic and methacrylic acid, from about 10 to 40, preferably from about 5 to 15 weight percent of one or more monomers selected from the group consisting of $C_8$-$C_{12}$ vinyl or vinylidene aromatic monomers, which may be unsubstituted or substituted by a $C_1$-$C_4$ alkyl radical or a chlorine, or bromine atom, and a $C_3$-$C_6$ alkenyl nitriles and acrylic and methacrylic acid. The acrylate polymers may optionally further contain from about 0.5 to 10, preferably less than 5 weight percent, of a functional monomer other than a $C_{1-8}$ alkyl or hydroxy alkyl ester of acrylic or methacrylic acid. Suitable monomers were discussed above in relation to the styrene-butadiene type polymers.

The resin of the emulsion may further be an $C_{1-8}$ monoolefin-vinyl ester copolymer wherein the vinyl ester is an ethylenically unsaturated ester of a saturated carboxylic acid. Particularly preferred is vinyl acetate. Such copolymers typically comprise up to about 95 percent by weight of, preferably from about 5 to about 40 weight percent of a $C_{1-8}$ monoolefin. A $C_2$-$C_3$ monoolefin is preferred. The copolymer may further be derived from a hydroxy alkenyl ester of a $C_{1-8}$ saturated carboxylic acid. Lastly, the copolymer may optionally contain from about 0.5 to 10, preferably from about 0.5 to 5, weight percent of one or more of the functional monomers referenced above.

The emulsion for use in the intumescent material may further comprise a silicone emulsion. Such emulsions are well known in the art. See, for example, U.S. Pat. Nos. 2,891,920; 3,294,725; 3,360,491; 2,702,276; 2,755,194; 4,194,988; 3,795,538, all of which are herein incorporated by reference.

The weight ratio of polymer:solvent in the emulsion is generally between 30:70 to about 70:30.

In a preferred embodiment, the resinous emulsion is characterized as having a glass transition temperature, $T_g$, below −40° C. In those instances, where the glass transition temperature of the emulsion is not below −40° C., a liquid plasticizer may be used. Suitable plasticizers for decreasing the glass transition temperature of the emulsion to an acceptable level are octyl epoxy soyate, epoxy tallates, epoxidized soybean oil, epoxidized linseed oil, triphenyl phosphate, neopentyl glycol dibenzoate, glycerine, vegetable oil and mineral oil. Typically, no more than 1 to about 10 weight percent of plasticizer, based on the weight of the resin, is needed.

Suitable for use as the fire retardant for use in the intumescent material are conventional agents known in the art. Such agents include, but are not limited to, organic phosphates including an amine phosphate, a trialkyl phosphates such as tributyl phosphate and triethyl phosphate, halogenated alkyl phosphates such as tris (2,3-dibromopropyl) phosphate, ammonium phosphates including diammonium phosphate and ammonium polyphosphates, melamine phosphate, melamine ammonium polyphosphate, diammonium sulfate and blends thereof, such as a blend of monoammonium phosphate and diammonium phosphate having a nitrogen-to-phosphorus ratio of at least about 1.25 and a blend of monoammonium phosphate, diammonium sulfate and diammonium phosphate having a nitrogen-to-phosphorus ratio of at least 1.25.

Preferred flame retardants for use in the intumescent material include amine/phosphorus containing salts. In general, these are amine salts of phosphoric acid or lower alkyl esters thereof. Lower alkyl esters means that $C_1$-$C_8$ alkyl ester has been made of one or more sites on the phosphoric acid group. Most preferably, a $C_1$-$C_4$ alkyl esters are used and most preferably an ethyl ester or no ester group is used.

The amount of flame retardant in the composition prior to extrusion is between from about 1 to about 70, preferably between from about 10 to about 40, weight percent.

Further preferred are lower alkyl diamine phosphates, such as $C_2$-$C_8$ alkyl diamine phosphates, most preferably $C_2$-$C_4$ alkyl diamine phosphates. Due to its relatively high phosphorus content and since it can be obtained inexpensively from commercial sources, ethylene diamine phosphate is especially preferred.

Expandable graphites for use in the present invention are graphites of any type which are expandable on heating. They may be solid, swollen or already partly expanded and may expand, for example, by 10 to 800 percent by volume or more. Such expandable graphites are well known in the art. They are in general graphites in whose interstitial planes foreign atoms, ions or molecular groups are incorporated.

Preferred graphites are so-called $NO_x$ and $SO_x$ expandable graphites which can be prepared by the action of sulfuric or nitric acid on graphite, optionally in the presence of an oxidizing agent, such as hydrogen peroxide. The acid components of the resulting product are generally encapsulated within the graphite matrix. Suitable expandable graphites can also optionally be obtained by an electrochemical method. The composition of the invention prior to extrusion contains between from about 5 to about 95, preferably between from about 10 to about 40, weight percent of expandable graphite.

The expandable graphite can also be used in admixture with other expandable or nonexpandable additives. For instance expandable inorganic filler have been found to render particularly advantageous results when used in conjunction with expandable graphite. Such inorganic fillers include perlite, vermiculite, expandable glasses, micas, clay, talc, borosilicates, cokes, charcoals, hard coals, brown coals, graphite granules, cork granules, wood granules, calcium carbonate, cereal grains, cork, bark granules, expandable clay, foamed concrete, metal sponge, pumice, tuff and/or lava. In a preferred embodiment, a hydrated aluminum silicate is used, such as those commercially available which contain mostly kaolin with a relatively small amount of titanium oxide. When present, such inorganic fillers may be present in the composition of the intumescent material prior to extrusion in an amount between from about 1 to about 50, preferably between from about 1 to about 25, weight percent.

The composition of the intumescent material may further comprise (prior to extrusion) between from about 1 to about 25 weight percent of a surfactant. Anionic, cationic or nonionic surfactants may be used. Exemplary non-ionic surfactants are fatty acid alkanolamides, linoleamide, tallow monoethanolamide ethoxylate, ethylene oxide adducts of a higher primary alcohol such as a nonylphenol, such as Surfonic N-85, or an ethoxylated amine as well as sorbitan monooleate, polyoxyethylene (2) oleyl ether, polyoxyethylene (20) sorbitan monooleate, a $C_9$-$C_{11}$ linear alcohol ethoxylate as well as a block copolymer of propylene and ethylene oxide, glyceryl laurate. In a preferred embodiment of the present invention, a surfactant comprising octylphenoxypolyethoxyethanol, water, and polyethylene glycol was used.

The composition of the intumescent material further contains a defoamer. In a preferred embodiment, a non-silicone defoamer is used. The defoamer is present in the composition (prior to extrusion) in an amount generally between about 0.15 to about 10 weight percent. In a preferred embodiment of the invention, an oil-based defoamer comprising a plurality of petroleum hydrocarbons and fatty amides was used. Such defoamers include the fatty amides such as the reaction products of a (i) polyamine such as ethylene diamine, butylene diamine, diethylene triamine, triethylene tetramine, hexamethylene diamine, decamethylene diamine, hydroxyethyl ethylene diamine, and 1,3-diamine-2-propanol, and (ii) fatty acid such as those having from 6 to 18 carbon atoms.

Usual optional adjuvants can also be included within the composition of the intumescent material. These adjuvants include reinforcing agents, process aids, stabilizers, pigments, coupling agents or a biocide. In a preferred embodiment of the invention, the composition contains less than one weight percent of a biocide such as commercially available biocides containing glycol ether and 3-iodo-2-propynyl butyl carbamate or formaldehyde.

Suitable as reinforcing agents are fibrous substances, such as polyesters, comprising less than one percent of the total composition.

A particularly desirable composition of the intumescent material is one which contains (prior to extrusion) the following components:

| Ingredient | Approximate weight percentage range |
|---|---|
| Resinous Emulsion | 30-60 |
| Expandable graphite | 10-40 |
| Fire retardant | 10-40 |
| Surfactant | <5 |
| Remainder filler materials | Balance |

Once this mixture has been thoroughly mixed and blended, preferably in the mixing tank, the mixture is preferably extruded into thin strips to create strips of a desired thickness, width, and length. The strips may be entirely composed of the extruded material. Alternatively, in a preferred embodiment, the mixture may be extruded onto thin flexible strips composed of wax paper, mineral wool, artificial fiber ribbons such as tetrahydrofuran fibers and aromatic amide fibers, polyethylene film, polypropylene film, polyurethane film or polyester film. In a preferred method of production, the extrusion process is performed with a ram extruder also at no more than the greater of ambient or room temperature.

Figure 5:
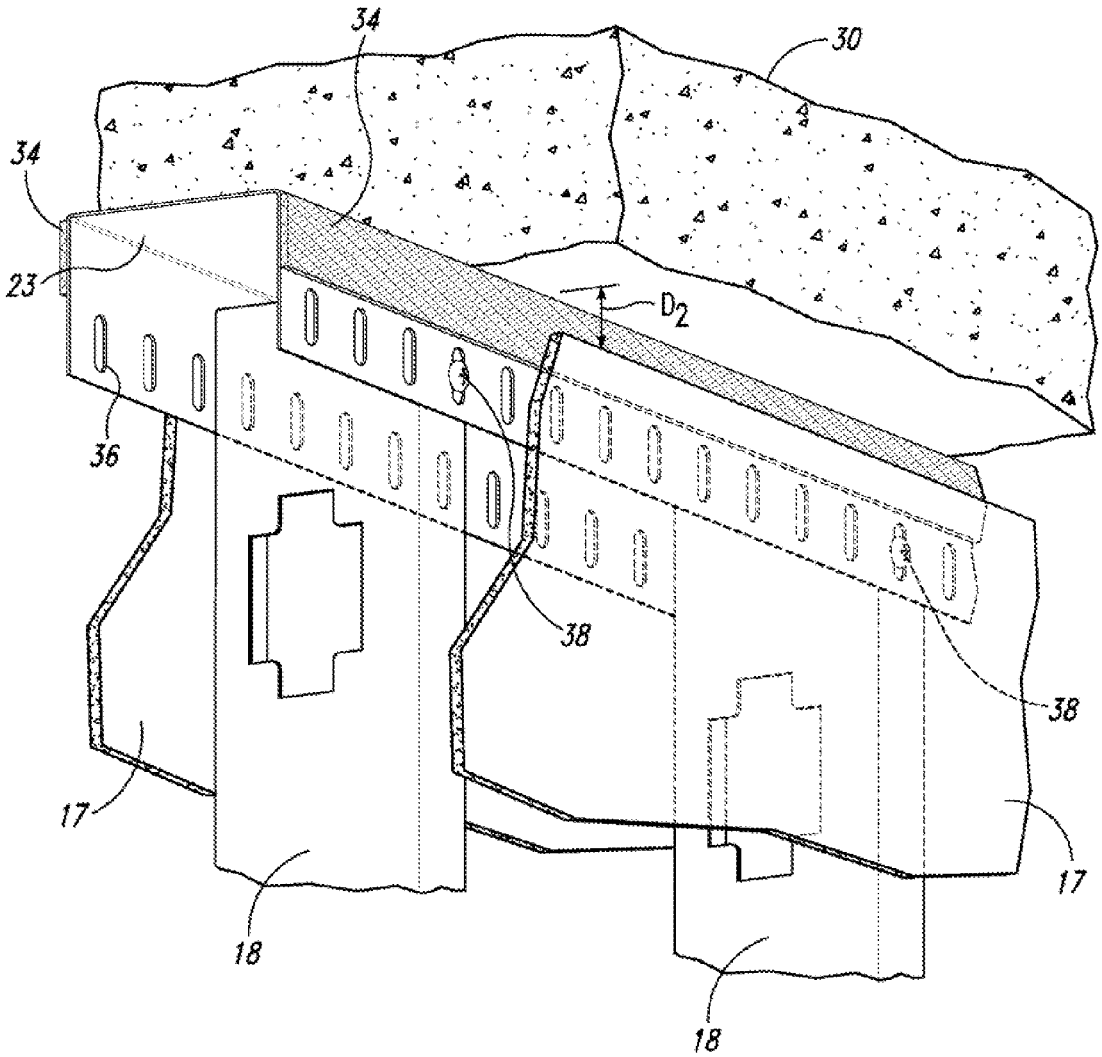
FIG. 5 illustrates a side perspective underneath partial view of the upper section of the fire retardant head-of-wall assembly shown in FIG. 1.

In a preferred embodiment, the elongated sheet-metal header track 16 (of the head-of-wall assembly 10) also comprises a plurality of vertically aligned slots 36 positioned at regular intervals along the pair of downwardly extending sidewalls 28. Each slot 36 has a preferred slot length $D_3$ that is generally at least about two times greater than the first and second gap distances $D_1$, $D_2$, or preferably ranging from about ½ inch to about 6 inches (wherein each slot 36 may be partially covered by the intumescent strip 34). In this preferred embodiment, a plurality of fasteners 38 secure the upper end portions 20 of the plurality of studs 18 to the header track 16, with each fastener 38 extending through one of the slots 36 and preferably being positioned about midway along each respective slot length $D_3$ as shown in FIG. 5. Each fastener 38 includes a fastener head that protrudes away from the outer sidewall surface 30 (of one of the sidewalls 28) a fastener head offset distance that is about the same or slightly less than the thickness of the intumescent strip 34 (thereby ensuring that the outer planar strip surface 35 of the intumescent strip 34 remains in intimate contact with the elongated upper planar interior wallboard surface 21 so as to maintain a smoke and fire seal at all times, especially during a ceiling 30 deflection or cycling event)). In this configuration, the inventive fire retardant head-of-wall assembly 10 is able to readily accommodate ceiling deflections because the studs 18 and fasteners 38 are relatively unencumbered with respect to up and down ceiling 30 deflections (vertical movements over at least the first and second gap distances $D_1$, $D_2$ and half the slot lengths $D_3$). Moreover and when exposed to a heat source (not shown) such as a building fire, the intumescent strip 34 is able to expand so as to at least partially fill the construction joint or gap 12 as shown in FIG. 3B; and in so doing, retard or prevent the spread of smoke and fire.

For purposes of illustration and not restriction, the following Example demonstrates various aspects and utility of the present invention.

EXAMPLE 1

Several mock-ups of a fire retardant head-of-wall assembly in accordance with the present invention were constructed and tested to evaluate the joint system's resistance to a heat source followed by a hose stream in accordance with Underwriters Laboratories, Inc.'s standards set forth in its Tests for Fire Resistance of Building Joint Systems—UL 2079. Each mock-up was constructed so as to have a ⅜ inch head-of-wall linear construction gap, and the construction gap was cycled over this distance (translating to a maximum of a ¾ inch gap when the ceiling was upwardly deflected a maximum distance of ⅜ inch, and to a minimum of no gap when the ceiling was downwardly deflected a maximum distance of ⅜ inch) in order to demonstrate that the head-of-wall assembly was able to withstand (meaning without failure of any of the wall assembly components) various levels of cycling. More specifically, the several mock-ups successfully passed cycling Levels I, II, and III (with Level I=1 cycle/min for 500 cycles (thermal expansion/contraction), Level II=10 cycles/min for 500 cycles (wind sway forces), and Level III=30 cycles/min (seismic forces)). After the successful cycling demonstration, the linear construction gap of one of the mock-ups was opened to its ¾ inch maximum and the whole mock-up was for a two hour period placed parallel and adjacent to an open oven heated to 1800° F. During this period no appreciable amounts of smoke or fire penetrated through the fire retardant head-of-wall assembly, and substantially all of the unexposed or far side wall materials (inclusive of the intumescent strip) remained intact and in place (meaning that the mock-up passed UL's "F-rating" for restricting fire passage). In addition, all of the unexposed or far side wall materials (inclusive of the intumescent strip) remained below 425° F. (meaning that the mock-up passed UL's "T-rating" for restricting thermal passage). Finally, and within about 5 minutes of being exposed to the open oven heat source, the exposed or near wall was subjected to a "hose stream" test (i.e., a 4 inch fire hose having a straight nozzle water stream at 30 psi for 30 seconds) and no direct water stream penetrated through the wall (meaning that the mock-up passed UL's "H-rating" for restricting hose stream passage). In view of the foregoing, the inventive fire retardant head-of-wall assembly has been certified as complaint with respect to Underwriters Laboratories, Inc.'s standards set forth in its Tests for Fire Resistance of Building Joint Systems—UL 2079.

While the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing descriptions, and all changes that come within the meaning and range of equivalency of the claims are to be embraced within their scope.

What is claimed is:

1. A fire retardant head-of-wall assembly configured to seal a linear head-of-wall construction joint or gap when exposed to a heat source, comprising:

an elongated sheet-metal footer track;

an elongated sheet-metal header track confronting and vertically spaced apart from the footer track, the header track including a web integrally connected to a pair of spaced apart and downwardly extending sidewalls, the web having a top exterior web surface positioned adjacent to a ceiling and a bottom interior web surface, each sidewall having inner and outer sidewall surfaces, each sidewall having an upper sidewall portion adjacent to the web and a lower sidewall portion;

an elongated heat expandable intumescent strip affixed lengthwise on at least one of the outer sidewall surfaces of the pair of sidewalls, the intumescent strip being positioned on the upper sidewall portion, the intumescent strip having an outer strip surface offset from the outer sidewall surface an intumescent strip offset distance;

a plurality of sheet-metal studs having upper and lower end portions, the studs being vertically positioned between the spaced apart and confronting footer and header tracks such that the lower end portions are received into the footer track and the upper end portions are received into the header track, each of the upper end portions of the plurality of studs being spaced apart from the bottom interior web surface of the header track a first gap distance that allows for ceiling deflections; and wallboard attached to at least one side of the plurality of studs, the wallboard having a top linear end surface positioned apart from the ceiling a second gap distance that allows for ceiling deflections and defines the linear head-of-wall construction joint or gap, the wallboard having an elongated upper interior wallboard surface in linear contact with the outer strip surface of the elongated intumescent strip.

2. The fire retardant head-of-wall assembly of claim 1 wherein the first gap distance and the second gap distance are the same or about the same.

3. The fire retardant head-of-wall assembly of claim 1 wherein the first gap distance and the second gap distance each range from about ⅛ inch to about ⅝ inch.

4. The fire retardant head-of-wall assembly of claim 1, further comprising a plurality of fasteners securing the upper end portions of the plurality of studs to the header track, each fastener extending through one of the pair of sidewalls of the header track and the upper end portion of one of the plurality of studs, each fastener including a fastener head that protrudes away from the outer sidewall surface of the sidewall a fastener head offset distance, the fastener head offset distance being about the same or slightly less than the intumescent strip offset distance.

5. The fire retardant head-of-wall assembly of claim 4 wherein the elongated sheet-metal header track includes a plurality of vertically aligned slots positioned along at least one of the pair of downwardly extending sidewalls, with each fastener extending through one of the plurality of slots.

6. The fire retardant head-of-wall assembly of claim 5 wherein each vertically aligned slot has a length that is about twice the first gap distance.

7. The fire retardant head-of-wall assembly of claim 6 wherein the fasteners are positioned about in the middle of its respective vertically aligned slot.

8. The fire retardant head-of-wall assembly of claim 5 wherein the intumescent strip partially covers each of the plurality of vertically aligned slots.

9. The fire retardant head-of-wall assembly of claim 1 wherein the intumescent strip has a width that is at least about twice the first gap distance.

10. The fire retardant head-of-wall assembly of claim 9 wherein the top linear end surface of the wallboard is positioned perpendicular and about midway along the width of the intumescent strip.

11. The fire retardant head-of-wall assembly of claim 1, further comprising an adhesive interposed between the intumescent strip and the at least one of the outer sidewall surfaces of the pair of sidewalls.

12. An elongated U-shaped sheet-metal track, comprising:

an elongated web integrally connected to a pair of spaced apart and outwardly extending sidewalls with the web and sidewalls defining a U-shaped profile, each sidewall having inner and outer sidewall surfaces, each sidewall having a plurality of slots positioned perpendicular to the lengthwise direction of the elongated web, each sidewall having a first sidewall portion adjacent to the web and a second sidewall portion adjacent to the first sidewall portion; and an elongated heat expandable intumescent strip affixed lengthwise on at least one of the outer sidewall surfaces of the pair of sidewalls, the intumescent strip being positioned on the first sidewall portion and not on the second sidewall portion.

13. The elongated U-shaped sheet-metal track of claim 12 wherein each of the plurality of slots is positioned on the first and second sidewall portions.

14. The elongated U-shaped sheet-metal track of claim 13 wherein the intumescent strip partially covers each of the plurality of slots.

15. The elongated U-shaped sheet-metal track of claim 12, further comprising a fire retardant adhesive interposed between the intumescent strip and the at least one of the outer sidewall surfaces of the pair of sidewalls.

* * * * *